US005400908A

United States Patent [19]

Prestwood

[11] Patent Number: 5,400,908

[45] Date of Patent: Mar. 28, 1995

[54] METHOD AND APPARATUS FOR SEPARATING MATERIALS OF DIFFERENT WEIGHTS

[76] Inventor: James R. Prestwood, 287 Ivy Ln., Auburn, Ala. 36830

[21] Appl. No.: 97,123

[22] Filed: Jul. 26, 1993

[51] Int. Cl.[6] ..... B07B 9/02

[52] U.S. Cl. ..... 209/25; 209/135; 209/143; 209/420; 209/639

[58] Field of Search ..... 209/24, 25, 32, 33, 209/134, 135, 142, 143, 420, 638, 639, 642

[56] References Cited

U.S. PATENT DOCUMENTS

| | | | |
|---|---|---|---|
| 828,529 | 8/1906 | Brewster | 209/24 |
| 1,290,241 | 1/1919 | Kohler | 209/25 X |
| 1,789,996 | 1/1931 | Bettenga | 209/33 |
| 4,395,866 | 8/1983 | Mathews | 56/16.4 |
| 4,519,896 | 5/1985 | Vickery | 209/33 X |
| 4,558,559 | 12/1985 | Klever et al. | 56/16.4 |
| 4,610,128 | 9/1986 | Ermacora | 56/16.4 |
| 4,851,110 | 7/1989 | Rolle et al. | 209/135 |
| 4,901,393 | 2/1990 | Tucker | 56/16.4 |
| 4,950,388 | 8/1990 | Stafford | 209/135 |
| 4,979,622 | 12/1990 | Chang | 209/135 X |
| 5,032,256 | 7/1991 | Vickery | 209/32 X |

FOREIGN PATENT DOCUMENTS

| | | | |
|---|---|---|---|
| 1112945 | 10/1954 | France | 209/134 |
| WO86/5420 | 9/1986 | WIPO | 209/33 |

*Primary Examiner*—D. Glenn Dayoan
*Attorney, Agent, or Firm*—John R. Flanagan

[57] ABSTRACT

An apparatus for separating constituents of a mixture of dry organic material having different weights or densities, such as pine straw and lawn debris, includes a cylindrical housing that is positioned horizontally with respect to a working surface. The housing has a hopper on its top side, an inlet end and an outlet end, and a fan is mounted at the inlet end. The fan pulls air into the housing and generates a stream of air flow inside the housing from the inlet end to the outlet end thereof. An air baffle structure is located immediately downstream of the fan to produce substantial turbulence in the air flow stream. The mixture of material to be separated is introduced into the housing through the hopper and is then carried from the housing and separated into constituent parts by the stream of air flow. Higher density constituents are deposited at shorter distances from the housing outlet end while lower density constituents are deposited at a greater distance from the housing outlet.

20 Claims, 1 Drawing Sheet

MIXTURE IN
AIR IN
LEAVES
DIRT & DEBRIS
PINE STRAW

METHOD AND APPARATUS FOR SEPARATING MATERIALS OF DIFFERENT WEIGHTS

BACKGROUND OF THE INVENTION

1. Field of the Invention

The present invention generally relates to processing of yard debris into constituent components for reuse and, more particularly, is concerned with a method and apparatus for separating pine straw from common yard debris so that the pine straw can be reused for decorative purposes.

2. Description of the Prior Art

Pine straw is a decorative landscaping material comprised primarily of intact pine needles. Although this material provides an attractive and decorative ground covering for landscaped areas around trees and shrubs, it is well known by those skilled in the art of landscaping and landscape maintenance that pine straw will gradually accumulate leaves, grass clippings and other lawn debris. The current practice of those skilled in the art of landscape maintenance, is to attempt to manually and mechanically separate lawn debris from pine straw or discard pine straw when it has become contaminated with lawn debris. The former method is labor intensive, the latter is wasteful and environmentally disadvantageous. Thus, heretofore no effective and reliable method and apparatus has been presented for cleaning and recycling decorative pine straw.

U.S. Pat. No. 4,901,393 to Tucker exemplifies prior art methods and apparatuses for separating organic materials. Tucker discloses a device for removing contaminants such as dirt, dust and mold from hay. The operator feeds hay into the inlet end of Tucker's apparatus. A set of rotary tines in combination with a stationary rake beat and agitate the hay as it is drawn across a screen connected to a vacuum pump. The vacuum pump draws dirt, dust and mold out of the hay, as the hay is discharged to an outlet, thus improving the hay for animal feeding purposes. Although Tucker's device would be useful for removing smaller particulate materials, its vacuum screen would not be suitable for separating similarly sized but differently weighted organic constituents.

Consequently, a need exists for a way to separate similarly sized but differently weighted constituents of mixture of dry organic material, such as pine straw from lawn debris.

SUMMARY OF THE INVENTION

The present invention provides a method and apparatus for separating constituents of dry organic material which satisfy the aforementioned need. The method and apparatus of the present invention generates a horizontal moving column or stream of air flow and introduces a mixture of dry organic material into the air flow stream such that the organic material separates as it is falling and being carried by the moving air column and then ultimately deposited at different distances from the point the mixture was introduced into the moving air flow stream. Thus, a simple and effective way is provided to separate and thus clean pine straw from lawn debris based on their different densities or weights.

Accordingly, the present invention is directed to an apparatus for separating constituents of a mixture of dry organic material having different weights. The separating apparatus comprises: (a) a hollow tubular housing having an interior and exterior, opposite top and bottom sides, and opposite inlet and outlet ends, the housing also having a top opening in the top side spaced from the inlet and outlet ends and communicating the exterior with the interior of the housing; (b) an air transfer mechanism mounted to the housing adjacent to the inlet end of the housing and being operable to generate a column or stream of air flow through the housing in a direction from the inlet end toward the outlet end; and (c) a hopper mounted on the exterior and top side of the housing over the top opening therein and above air flow stream generated through the housing by operation of the air transfer mechanism, the hopper being adapted to receive a mixture of dry organic material having constituents of different weights and introduce the mixture into the stream of air flow such that the constituents of the mixture are carried by the stream of air flow from the outlet end of the housing through distances corresponding to their different weights and thereby deposited onto a working surface at different distances from the outlet end of the housing.

The present invention is also directed to a method for separating constituents of a mixture of dry organic material having different weights. The separating method comprises the steps of: (a) generating a stream of air flow in a substantially horizontal direction above a working surface; and (b) introducing a mixture of dry organic material having constituents of different weights into the air flow stream at a predetermined location such that the constituents of the mixture are carried by the air flow stream from the location through distances which correspond to their different weights and thereby are deposited onto the working surface at different distances from the location.

BRIEF DESCRIPTION OF THE DRAWINGS

In the following detailed description, reference will be made to the attached drawings in which.

DETAILED DESCRIPTION OF THE INVENTION

Figures 1, 2, 3:
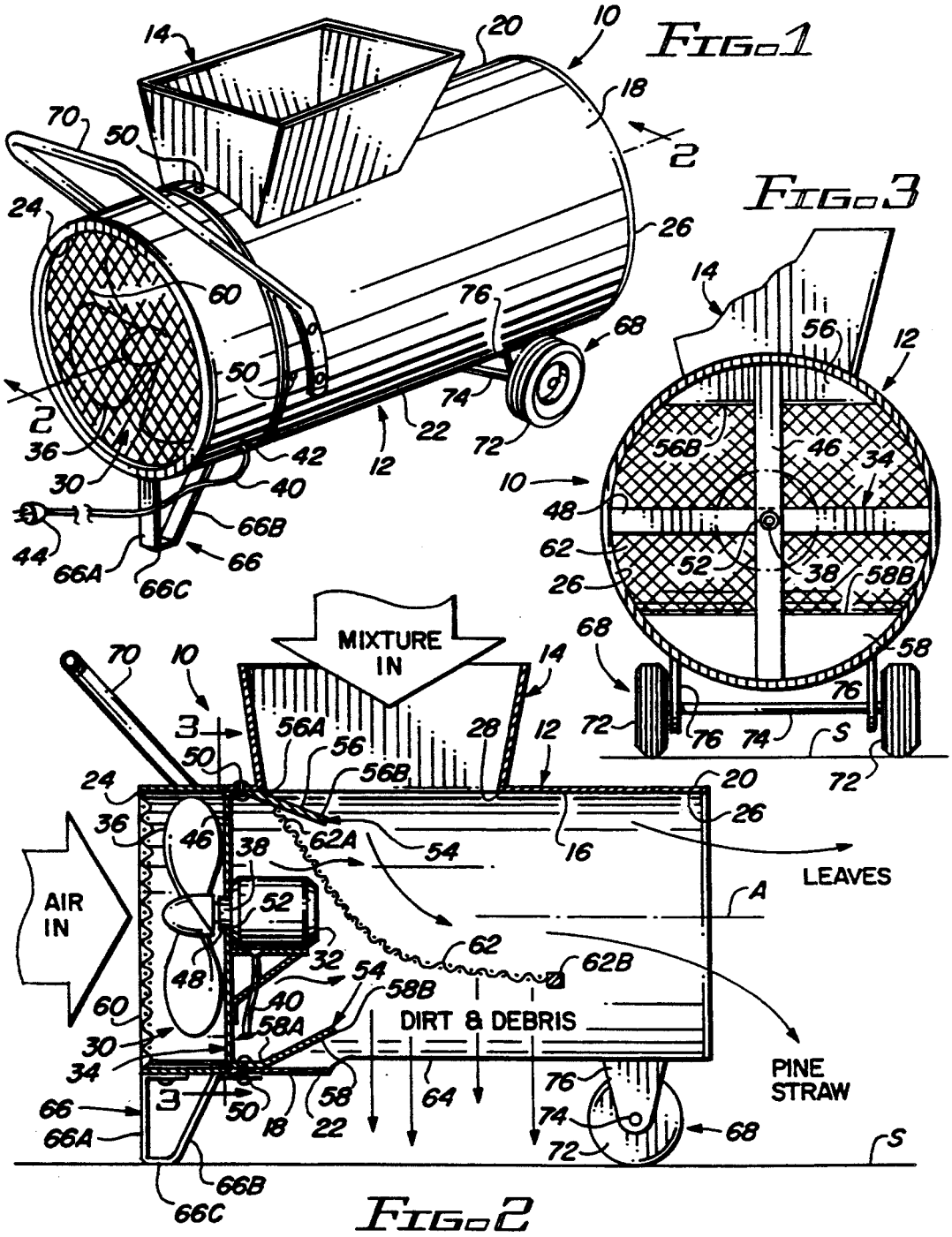
FIG. 1 is a perspective view of the separating apparatus of the present invention.
FIG. 2 is a longitudinal sectional view of the separating apparatus taken along line 2—2 of FIG. 1.
FIG. 3 is an end elevational view of the separating apparatus taken along line 3—3 of FIG. 2.

Referring to FIGS. 1–3 of the drawings, there is illustrated a separator apparatus of the present invention, generally designated 10, being operable for separating the constituents of a mixture of materials of different weights, such as pine straw and common lawn debris, into different piles on a working surface S. Basically, the separator apparatus 10 includes a substantially cylindrical hollow tubular housing 12 and an infeed hopper 14 mounted thereon. The tubular housing 12 has a substantially central longitudinal axis A and includes an inner surface 16, an outer surface 18, a top side 20, a bottom side 22, an inlet end 24, and an outlet end 26. The housing 12 also includes a top opening 28 defined in the top side 20 of the housing 12 nearer to the inlet end 24 than to the outlet end 26 thereof. The top opening 28 is surrounded by the infeed hopper 14. The hopper 14 has an inverted truncated configuration.

The separator apparatus 10 also includes an air transfer mechanism 30 mounted to the housing 12 in alignment with the inelt and outlet ends 24, 26 of the housing 12 and adjacent to the inlet end 24 thereof. The air transfer mechanism 30 is operable to generate a stream of air flow through the interior of the housing 12 in a substantially horizontal direction along the longitudinal axis A from the inlet end 24 toward the outlet end 26 thereof. The air transfer mechanism 30 includes a fan motor 32, a support structure 34 mounted to the housing 12 inwardly from and adjacent to the inlet end 24, and a fan 36 connected to the fan motor 32 by a rotatably driven fan shaft 38. The fan 36 and motor 32 are oriented so that the fan 36 is located upstream of the motor 32 nearer to the inlet end 24. An electric cord 40 is electrically attached to the fan motor 32, exits through a hole 42a in the housing 12 and terminates in a standard outlet plug 44. While an electric motor 32 is disclosed herein, it should be understood that any drive source suitable for generating a stream of air flow could be utilized within the purview of the present invention, such sources ranging from a gasoline engine to the power takeoff shaft of a tractor.

The support structure 34 includes a vertical radial support member 46 and a horizontal radial support member 48 in the form of substantially flat strips of metal that are positioned substantially perpendicular with the longitudinal axis A of the housing 12. The radial support members 46, 48 of the support structure 34 are attached at bent opposite end flanges thereon to the inner surface 16 of the housing 12 by fasteners 50. The radial support members 46, 48 are positioned so that they cross each other at their centers. The radial support members 46, 48 have holes 52 at their centers that are coaxially aligned for accepting the fan shaft 38 therethrough such that the fan shaft 38 rotates about the central longitudinal axis A of the cylindrical housing 12.

The separator apparatus 10 further includes an air baffle structure 54 mounted to the tubular housing 12 and disposed therein radially outwardly from the fan motor 32 and downstream of fan 36 of the air transfer mechanism 30. The baffle structure 54 functions to disrupt the stream of air flow between the inlet and outlet ends 24, 26 of the housing 12 so as to produce turbulence in air flow stream which contributes to the ability of the apparatus 10 to separate the mixture into its constituents based on differences in their weight.

More particularly, the air baffle structure 54 includes an upper baffle plate 56 and a lower baffle plate 58. Both the upper and lower baffle plates 56, 58 have flat orientations and are oriented at reverse acute angles with respect to the longitudinal axis A of the housing. The upper baffle plate 56 is attached on the inner surface 16 of the top side 20 of the housing 12 downstream of the fan 36, while the lower baffle plate 58 is attached on the inner surface 16 of the bottom side 22 of the housing 12 downstream of the fan 36. The upstream edges 56A, 58A of the upper and lower baffle plates 56, 58 are contoured to conform to the cylindrical inner surface 16 of the housing 12, while the downstream edges 56B, 58B describes substantially straight lines. The separator apparatus 10 also includes a circular screen-type guard 60 pervious to air flow. The guard 60 is mounted to the tubular housing 12 and extends across inlet end 24 thereof.

Further, optionally, a debris separating screen 62 can be provided in the housing 12 directly downstream of the fan 36. The separating screen 62 has an upstream edge 62A and a downstream edge 62B. The separating screen 62 is attached at its upstream edge 62A to the housing 12 via the upper baffle plate 56. On the other hand, the downstream edge 62B of the separating screen 62 is unsupported and is positioned downstream of the hopper 14, substantially lower than its upstream edge 62A. The right and left edges of the separating screen 2 are contoured to follow the inner surface 16 of the housing 12 as the screen 62 slopes downwardly from its upstream edge 62A to its downstream edge 62B. Thus, the separating screen 62 is mounted in the interior of the housing 12 and disposed below the infeed hopper 14 and the top opening 28 of the housing 12 in a declining orientation.

The separating screen 62 is also disposed above a bottom opening 64 defined in the bottom side 22 of the tubular housing 12. The screen 62 functions to separate dry organic material from solid debris which is heavier than the dry organic material by permitting only the heavier solid debris to pass and drop through the bottom opening 64 of the housing 12. The small more dense constituents are allowed to fall immediately to the working surface from the hollow housing 12 while momentarily supporting larger less dense constituents before they are carried from the housing by the stream of air flow.

The separator apparatus 10 is shown standing stationarily at one location in its normal operating position. However, the separator apparatus 10 is readily movable to other locations. For providing these capabilities, the separator apparatus 10 includes a support bracket 66 and a set of wheels 68 mounted at the exterior and on the outer surface 18 of the housing 12 respectfully adjacent to the inlet and outlet ends 24, 26 thereof for supporting the housing 12 above the working surface S. The separator apparatus 10 also includes a handle 70 mounted at the exterior and on the outer surface 18 of the housing 12 adjacent to the inlet end 24 thereof. The handle 70 is adapted for use in lifting the one end of the housing 12 so that the apparatus 10 may be moved along the working surface S upon the set of wheels 68.

More particularly, the support bracket 66 mounted on the bottom side 22 of the housing 12 has a first vertical leg 66A, a second inclined leg 66B and a horizontal foot 66C which extends between and connects with the lower ends of the first and second legs 66A, 66B. The foot 66C rests on the working surface S. The wheel assembly 68 includes a pair of wheels 72 mounted at opposite ends of an axle 74. The axle 74 is held by a pair of braces 76 that are also positioned at opposite ends of the axle 74 and attached on the bottom side 22 near the outlet end 26 of the housing 12. The handle 70 has a generally inverted U-shaped configuration and is attached at opposite lower ends to the outer surface 18 of the housing 12 adjacent to the inlet end 24 thereof.

In order to operate the separator apparatus 10, an operator electrically connects the electric motor 32 to a power source (not shown) using the electric cord 40. The motor shaft 38 and fan 36 rotate to generate a moving column or stream of air flow that enters through the inlet end 24, constricts and accelerates as it passes the air deflection baffle structure 54 before exiting from the housing 12 at the outlet end 26 thereof. Additionally, as would be readily apparent to those skilled in the art, the air flow becomes much more turbulent as it passes over the baffle plates 56, 58 which creates advantages discussed hereinbelow.

After activating the fan 36, the operator then obtains and introduces a mixture of material comprised of a plurality of constituents having different densities through the hopper 14 and into the stream of air flow. As can be readily understood by those skilled in the art, each of the constituent materials having different densities react differently when introduced to the air stream flow. The air stream carries low density constituents a greater distance before they come to rest on the working surface S, while the air stream carries high density constituents a lesser distance before coming to rest on the working surface.

Accordingly, as the mixture enters the air stream, it begins to separate into its constituent components according to their densities. The separation of components is further enhanced by the turbulent nature of the air flow. As the mixture is carried downstream it continues to separate. Some of the material is heavy enough to fall out through the bottom opening 64 of the housing 12. The remainder is ejected out the outlet end 26 and continues to separate into its constituents as relatively dense constituents come to rest on the working surface S relatively closer to the outlet end 26 of the housing 12 while relatively less dense constituents come to rest on the working surface farther from the outlet end 26 of the housing 12. The mixture is thus separated as the operator continues to feed more material into the housing 12 of the separator apparatus 10 through the hopper 14.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. An apparatus for separating constituents of a mixture of dry organic material having different weights, said separating apparatus comprising:

(a) a substantially cylindrical hollow tubular housing having a substantially central longitudinal axis and including an interior and exterior, opposite top and bottom sides, and opposite inlet and outlet ends, said housing also having a top opening in said top side spaced from said inlet and outlet ends and communicating said exterior with said interior of said housing;

(b) an air transfer mechanism mounted to said housing in alignment with the opposite inlet and outlet ends thereof and adjacent to said inlet end of said housing and being operable to generate a stream of air flow through said housing in a direction along said longitudinal axis from said inlet end toward said outlet end, said air transfer mechanism including drive means mounted to said housing and disposed in said interior thereof spaced inwardly from said inlet end of said cylindrical housing, a shaft mounted to said drive means and rotatably driven by said drive means about said longitudinal axis of said cylindrical housing and a fan disposed within said cylindrical housing between said inlet end thereof and said drive means and mounted to said shaft and driven by said drive means to rotate about said longitudinal axis of said cylindrical housing; and (c) a hopper mounted on said exterior and said top side of said housing over said top opening therein and above said stream of air flow generated through said housing and along said longitudinal axis thereof by operation of said air transfer mechanism, said hopper being adapted to receive a mixture of dry organic material having constituents of different weights and introduce the mixture into said stream of air flow such that the constituents of the mixture are carried by said stream of air flow from said outlet end of said housing through distances corresponding to their different weights and thereby deposited onto a working surface at different distances from said outlet end of said housing.

2. The apparatus as recited in claim 1 wherein said hopper is located closer to said inlet end of said housing than to said outlet end thereof.

3. The apparatus as recited in claim 1 wherein said housing further has a bottom opening in said bottom side communicating said interior of said housing with said exterior thereof.

4. The apparatus as recited in claim 3 further comprising:

a debris separating screen mounted on said interior of said housing and disposed below said hopper and said top opening of said housing in a declining orientation extending from an upstream edge to a downstream edge of said screen, said screen also being disposed above said bottom opening of said housing and adapted to separate dry organic material from solid debris which is heavier than said dry organic material by permitting only the heavier solid debris to pass and drop through said bottom opening of said housing.

5. The apparatus as recited in claim 1 further comprising:

a support bracket mounted on said exterior of said housing adjacent to one of said inlet and outlet ends thereof for supporting said housing above said working surface; and a wheel assembly mounted on said exterior of said housing adjacent to the other of said inlet and outlet ends thereof.

6. The apparatus as recited in claim 5 further comprising:

a handle mounted on said exterior of said housing adjacent to said one of said inlet and outlet ends thereof and being adapted for use in lifting said one end of said housing so that said apparatus may be moved along said working surface upon said wheel assembly.

7. The apparatus as recited in claim 1 wherein said drive means of said air transfer mechanism is a fan motor.

8. The apparatus as recited in claim 7 wherein said fan motor is an electric motor having an electrical cord and plug electrically connectable to a power source.

9. The apparatus as recited in claim 1, further comprising:

a guard pervious to air flow being mounted to said housing and extending across inlet end thereof.

10. The apparatus as recited in claim 1 further comprising:

an air baffle structure mounted to said housing and disposed in said interior thereof downstream of said air transfer mechanism.

11. The apparatus as recited in claim 10 wherein said air baffle structure includes:

an upper baffle plate and a lower baffle plate;

said upper baffle plate having a substantially flat configuration and being attached on said top side of said housing downstream of said air transfer mechanism;

said lower baffle plate having a substantially flat configuration and being attached on said bottom side of said housing downstream of said air transfer mechanism.

12. The apparatus as recited in claim 10 wherein said hopper is located closer to said inlet end of said housing than to said outlet end thereof and is located downstream of said air baffle structure.

13. The apparatus as recited in claim 10 wherein said housing further has a bottom opening in said bottom side communicating said interior of said housing with said exterior thereof and located generally below said hopper and downstream of said air baffle structure.

14. The apparatus as recited in claim 13 further comprising:

a debris separating screen mounted on said interior of said housing and disposed below said hopper and said top opening of said housing in a declining orientation extending from an upstream edge to a downstream edge of said screen, said screen also being disposed above said bottom opening of said housing and adapted to separate dry organic material from solid debris which is heavier than said dry organic material by permitting only the heavier solid debris to pass and drop through said bottom opening of said housing.

15. A method for separating constituents of a mixture of dry organic material having different weights, said separating method comprising the steps of:

(a) providing a substantially cylindrical hollow tubular housing having a substantially central longitudinal axis extending between opposite inlet and outlet ends of said housing;

(b) generating a stream of air flow in a substantially horizontal direction along the central longitudinal axis of the housing from the inlet end through the outlet end thereof above a working surface by rotating about the longitudinal axis of the housing a fan disposed in the housing in alignment with the inlet and outlet ends of the housing and adjacent to the inlet end thereof; and (c) introducing a mixture of dry organic material having constituents of different weights into said stream of air flow at a predetermined location through a top opening in the housing such that the constituents of the mixture are carried out of said housing by said stream of air flow from said location through distances which correspond to their different weights and thereby are deposited onto the working surface away from the housing at different distances from said location.

16. The method as recited in claim 13 wherein said stream of air flow is generated through a hollow tubular housing from an inlet end to an outlet end thereof.

17. The method as recited in claim 15 wherein said mixture of dry organic material is introduced into the hollow tubular housing through said top opening therein by a hopper on a top side of the housing between the inlet and outlet ends thereof.

18. The method as recited in claim 15 wherein the constituents of the mixture are carried by said stream of air flow from the outlet end of the housing through distances which correspond to their different weights and thereby are deposited onto the working surface at different distances from said outlet end of said housing.

19. The method as recited in claim 15 further comprising the step of:

disrupting said stream of air flow between said inlet and outlet ends of said housing so as to produce turbulence in said stream of air flow.

20. The method as recited in claim 15 further comprising the step of:

permitting small dense constituents to fall immediately to the working surface from the hollow housing while momentarily supporting larger less dense constituents before they are carried from the housing by said stream of air flow.

* * * * *